United States Patent [19]

Ichimura

[11] Patent Number: 4,688,500

[45] Date of Patent: Aug. 25, 1987

[54] DEVICE FOR HOLDING A FABRIC IN BLIND STICH SEWING

[75] Inventor: Masatoshi Ichimura, Higashiosaka, Japan

[73] Assignee: Satoh Seiki Co., Ltd., Japan

[21] Appl. No.: 834,549

[22] Filed: Feb. 28, 1986

[30] Foreign Application Priority Data

Mar. 25, 1985 [JP] Japan ..... 60-60214

[51] Int. Cl.[4] ..... D05B 1/24

[52] U.S. Cl. ..... 112/176

[58] Field of Search ..... 112/176, 177, 178, 121.12, 112/121.15, 121.14, 121.11

[56] References Cited

U.S. PATENT DOCUMENTS

| | | | |
|---|---|---|---|
| 3,126,853 | 3/1964 | Maves | 112/176 X |
| 3,347,190 | 10/1967 | Roth | 112/176 |
| 3,677,208 | 7/1972 | Fletcher et al. | 112/178 |
| 4,443,731 | 3/1984 | Beisler | 112/121.14 |
| 4,577,570 | 3/1986 | Ichimura | 112/121.12 |
| 4,601,249 | 7/1986 | Frye | 112/121.14 |

FOREIGN PATENT DOCUMENTS

| | | |
|---|---|---|
| 5728 | 7/1879 | Fed. Rep. of Germany . |
| 43891 | 7/1888 | Fed. Rep. of Germany . |
| 892706 | 10/1953 | Fed. Rep. of Germany . |
| 2937733 | 4/1981 | Fed. Rep. of Germany . |
| 2552456 | 3/1985 | France . |

*Primary Examiner*—H. Hampton Hunter

*Attorney, Agent, or Firm*—Larson and Taylor

[57] ABSTRACT

A device for holding fabric pieces for blind stitch sewing. A rod which presses fabric pieces together and performs vertical reciprocating motions in synchronism with needle motions is adjusted by a level regulator which changes the lowest return point of the rod to adapt to different thicknesses of the fabric pieces being sewn.

4 Claims, 6 Drawing Figures

DEVICE FOR HOLDING A FABRIC IN BLIND STICH SEWING

FIELD OF THE INVENTION

This invention relates to a device for holding a fabric during blind stitch sewing. Specifically, this invention relates to a device for regulating the position of a rod to press fabric pieces during the formation of a pocket by blind stitch sewing. More specifically, this invention relates to a device for regulating the return point of the reciprocating stroke motion of a rod which presses the fabric cloth, which motion takes place in synchronism with the motion of the sewin needle.

BACKGROUND OF THE INVENTION

Blind stitch sewing is a method wherein yarn or thread emerges as a seam on only one side of the tailored fabric, without appearing on the other side. This special sewing method is generally applied for example in attaching a patch pocket or an outer pocket on a suit fabric since pocket formation may desirably be finished without a seam line showing on the front of the finished suit.

Conventionally, blind stitch sewing is performed by swinging motions of a curved need1e which reciprocatingly pierce the tailored fabrics in a slanted or lateral direction as contrasted with a perpendicular reciprocating motion by a straight needle. Accordingly, the pressure applied to the tailored fabric should be very carefully adjusted so as not to very widely or so as not to change sharply during the sewing motion. Nonetheless, wide variations or sharp changes of fabric pressure are likely to take place because of changes in the thickness of the fabrics being sewn. Formation of a patch pocket or a dart on a jacket suit are typical examples wherein the above described difficulties occur.

Some devices and methods suited to blind stitch sewing are described in U.S. Pat. No. 4,577,570, issued Mar. 25, 1986, which describes how to drive a sewing needle so as to direct its instantaneous motions to the tangential line of sewing curvatures and also to a device for operating the reciprocating motions of a rod to press tailored fabrics in synchronism with the motion of a sewing needle. However, this patent does not concern itself with the problem of regulating the lowest return point of reciprocating motion of the rod commensurate with a change in the thickness of the fabrics being sewn.

SUMMARY OF THE INVENTION

Thus, it is an object of the present invention to provide a device for holding tailored fabrics by nipping means which comprise means for changing a nip distance and also performing synchronized short reciprocating motions It is a specific object of this invention to provide a blind stitch sewing machine which comprises a device for maintaining a nip distance which varies with reference to synchronized, short reciprocating motions of a presser rod, while regulating the same nip distance by controlling the lowest stroke point of said motion.

These and other objects and advantages of the present invention, which will become apparent from the detailed description which follows, are accomplished in accordance with the present invention by introducing a new mechanism midway along a transmission line for the synchronized reciprocating motion from a power source to a presser rod, wherein the new mechanism is such that it involves a gap, the size of which can be decreased or increased by movements taking place in transmitting motion of adjacent elements, and which gap is also comparable to variable positions of the presser rod and such that, commensurate with an intended change of stroke length of the reciprocating motion of the presser rod, transmission of the motion is controlled lengthwise over the gap.

These and other objects of the present invention will become apparent from the detailed description to follow, taken together with the accompanying drawings.

BRIEF DESCRIPTION OF THE DRAWINGS

Referring now to the drawings, which illustrate a preferred embodiment of the present invention.

DETAILED DESCRIPTION OF THE PREFERRED EMBODIMENTS

Figure 1:
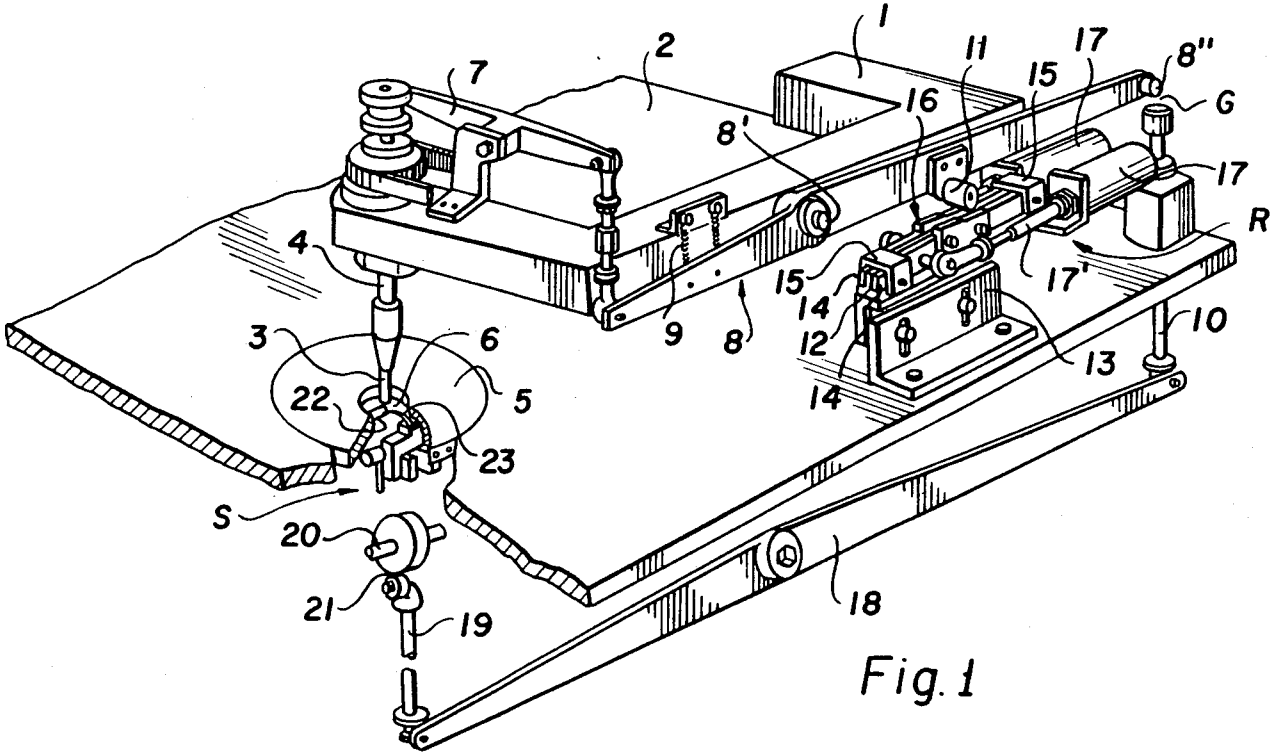
FIG. 1 is a perspective view, partially broken away, showing an embodiment of the present invention.

Referring now to the drawings, like elements are represented by like numerals throughout the several views.

In the drawings, bed stand 1 is mounted on an operation table 2. A presser rod 3 extends down from the tip of a rod 4 and terminates at about the level of the operation table 2. The aligned axes of rods 3 and 4 pass through the center of opening 6 of a circular table 5 which is received in the operation table 2. A connecting rod 7 is pivoted at its center and linked at one end to the rod 4 and at its other end it is connected to a rod 8. This rod 8 is pivotally connected off of its center at a fulcrum 8' and is positioned lower than the rod 7. The left half of rod 8 (as viewed in FIG. 1) is pulled upwardly by a spring 9 secured on the bed stand 1 and the right half of rod 8 (as viewed in FIG. 1) is provided along its length with a horizontally projecting bracket roller 11. The right hand end of rod 8 forms a tip 8'' which is positioned to be a free end with a gap G between said free end and the top of a rod 10.

Figure 2:
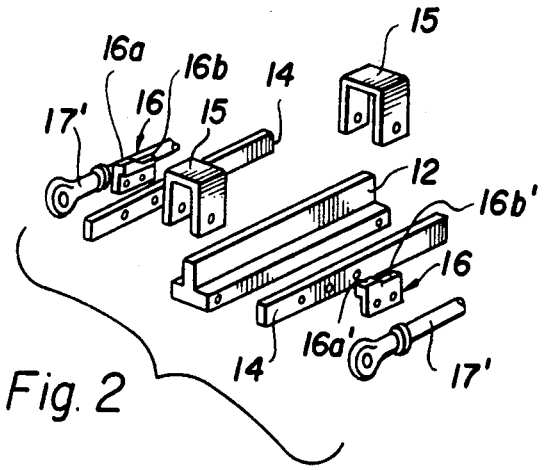
FIG. 2 shows the elements of FIG. 1 which constitute a level regulator, in a disassembled state.

A level regulator R comprises an inverse T section guide rail 12 which is secured to the operation table 2 by a member 13, to slide plates 14,14, which are fitted by means of holders 15,15 on opposite sides of the guide rail 12, wherein two slide blocks 16,16 each have a smooth stepwise inclination as denoted at **16*a*,16*b* and 16*a'*,16*b'* (see FIG. 2) and are fitted on the slide plates 14,14 so that bracket roller 11 may be located at any level of 16*a*,16*b* and/or 16*a'*,16*b'*. Further, the slide plates 14,14 are each linked to the rods 17',17' connected to the pistons 17,17. A vertical connecting rod 10 terminates below the rod end 8'' with the gap G therebetween. As described below, the size of this gap may be adjusted by action of the level regulator R. A pivotal connecting rod 18 is linked to the rod 10 and to a rod 19. Motor shaft 20 drives a sewing needle 23 wherein the only particulars of the sewing unit S which are shown here include the sewing needle 23, the shaft 20 and a cam link 21**. The other related elements are similar or comparable to those shown in said U.S. Pat. No. 4,577,570.

Figure 3:
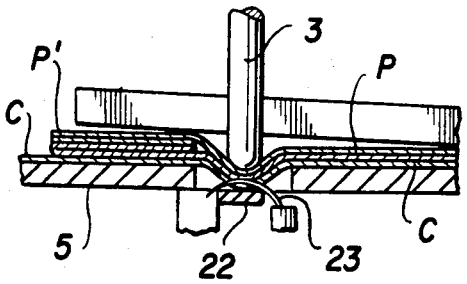
FIG. 3 is an enlarged cross-sectional view showing fabric pieces pressed together for sewing

Fabric holding plate 22 is designed to pair with the rod 3 located above it and, as shown in FIG. 3, is positioned at the center of the circular opening 6 to receive the fabrics in association with pressure by means of the rod 3. It is to be noted that in the said U.S. Pat. No. 4,577,570, a fabric holding plate was not provided, whereas in the present invention a bobbin case is provided for supplying sewing material so that the needle 23 may swing or stride over the holding plate 22 to reach the bobbin case, although particular configurations of these elements are not shown in the present drawings.

Figure 4:
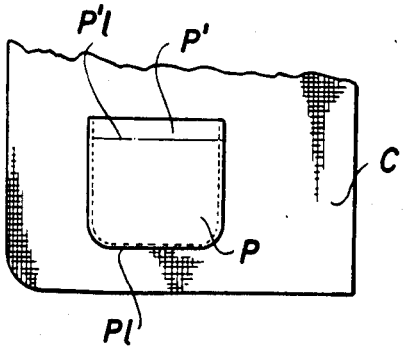
FIG. 4 illustrates a pocket formation on a suit fabric.

The operation of the elements of the invention will be apparent from an understanding of the device itself. Nonetheless, for purposes of clarity, such operation will be briefly described. A power source which drives the sewing needle is conveniently used also to synchronize motions of the presser rod 3 with the needle. Referring to the elements in FIG. 1, the synchronized drive for the rod 3 is transmitted via the following elements, taken in sequence: 20, 21, 19, 18, 10, 8, 7, 4 and 3. The desirability of synchronized motions and the change of the lowest stroke return point of the rod 3 and the needle 23 will be explained with reference to FIG. 3 in which a sewing o lateral piercing action of the needle into the fabric is carried out while the fabric is pressed or nipped mor firmly (the rod 3 is down). Forward movement of seamed points is then carried out by mechanical teeth or the like while the fabric is pressed less firmly (the rod 3 is up) as a result of synchronized motions. The pocket formation operation also undergoes variations of the nip distance between the rod 3 and the holding plate 22 which change the returning point of reciprocating motions frequently and immediately. As an illustration, referring to FIG. 4, sewing on the line P'1 requires a higher returning or stroke-end point of the rod 3 since the fabric is folded at P' to make a double thickness. Sewing on P1 requires a lower returning point because the fabric on P1 assumes a single thickness.

Figure 5:
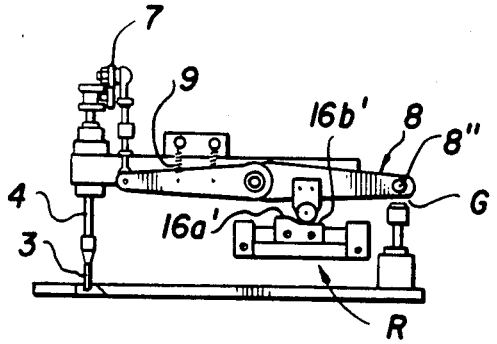
FIGS. 5 and 6 are schematic side elevational views of portions of FIG. 1, shown in different positions.
Figure 6:
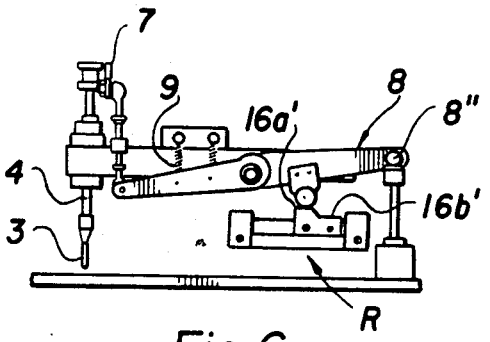

The change of a lowest stroke return point of the rod 3, commensurate with variation of fabric thickness during a pocket formation operation, is accomplished in the present invention by cooperation of the level regulator R and the pivoted rod 8. When the roller 11 secured on the rod 8 is shifted, for example from a lower level **16*b* to a higher level 16*a* (compare FIG. 5 to FIG. 6) which is comparable to the shift from 16*b'* to 16*a*, the lowest return point of the reciprocating motion of the rod 3 is made higher in accordance with the difference between 16*a* and 16*b*. Therefore, in operation, at the moment of changing the sewing from P1 to P'1, which means a change from lower to higher, the level regulator R is shifted, for example from 16*b* to 16*a*. And if the respective levels of 16*a*, 16*b*, 16*a'* and 16*b'*** are made different from each other, four different levels are made available. The number of available levels may be determined based on the needs of a given operation. The availability of a plurality of different levels is a feature of the present invention. This shifting action can be performed manually or in a more sophisticated manner, for example by computerized means in combination with controls of the entire sewing job, which more complex controls are not illustrated as they are outside of the description of the present invention.

As is apparent from the above, the present invention has been described with respect to a pocket sewing machine. However, the present invention is not limited to that application. The device of the present invention may advantageously be used for blind stitching operations for all types of applications, for example folded cuffs of trousers and other fabric portions where different effective thicknesses are produced by folding, patching or fitting of the fabrics.

Although the invention has been described in considerable detail with respect to preferred embodiments thereof, it will be apparent that the invention is capable of numerous modifications and variations, apparent to those skilled in the art, without departing from the spirit or scope of the invention.

I claim:

1. In a device for holding fabrics during a blind stitch sewing operation performed on a sewing machine of the type having a holding plate below the fabric and a presser rod pressing down on the fabric, and which presser rod moves through short reciprocating movements in synchronism with the sewing machine, the improvement comprising:

a pivotal rod pivotally connected at a fulcrum point to the sewing machine, said pivotal rod connected in a drive line to drive the presser rod through its reciprocating movements, a bracket roller mounted on the pivotal rod spaced from the fulcrum point, and a level regulator having a block which is engaged by said bracket roller and has a plurality of different levels, and means for shifting the block to place different levels at the poing where the block is engaged by the bracket roller, said pivotal rod having one free end which is positioned adjacent a transmission rod and usually spaced therefrom by a gap, and wherein the transmission rod closes the gap to engage the free end of the pivotal rod to drive the same and hence also drive the presser rod, wherein the positionof the pivotal rod, as adjusted by the level regulator, changes its relationship with the transmission rod and hence also changes the return point of the presser rod.

2. The invention of claim 1, wherein said level regulator is a sliding block and the plurality of different levels are formed by separate upper portions of said block, and including power means for sliding the block to said different positions.

3. The invention of claim 1, in which the sewing machine is a pocket sewing machine.

4. The invention of claim 1, wherein the side of the pivotal rod on the opposite side of the fulcrum from the free end of the pivotal rod is urged by spring means into a presser rod down position, and said transmission rod moves the free end of the rod to move the pivotal rod towards a presser rod up position.

* * * * *